United States Patent [19]

Taylor

[11] 4,370,989

[45] Feb. 1, 1983

[54] APPLICATOR FOR LIQUID COSMETICS

[76] Inventor: Charles H. Taylor, 15 Beacon Hill Rd., West Springfield, Mass. 01089

[21] Appl. No.: 77,093

[22] Filed: Sep. 19, 1979

Related U.S. Application Data

[63] Continuation of Ser. No. 823,744, Aug. 11, 1977, abandoned.

[51] Int. Cl.[3] ..... A45D 40/00

[52] U.S. Cl. ..... 132/79 B; 132/88.7

[58] Field of Search ..... 132/79, 88.5, 88.7; 169/30; 222/212, 190, 207, 211, 145, 95, 189, 207, 124; 239/343

[56] References Cited

U.S. PATENT DOCUMENTS

| | | | |
|---|---|---|---|
| 2,088,791 | 8/1937 | Huthsing | 169/30 X |
| 2,213,765 | 9/1940 | Iddings | 169/30 |
| 2,510,269 | 6/1950 | Winter | 169/30 |
| 3,300,099 | 1/1967 | Marona | 222/207 |
| 3,499,583 | 3/1970 | Hauer et al. | 222/211 |
| 3,896,822 | 7/1975 | Zimmerman | 132/79 B |
| 4,022,351 | 5/1977 | Wright | 222/212 |
| 4,027,789 | 6/1977 | Dickey | 222/190 |

*Primary Examiner*—G. E. McNeill

*Attorney, Agent, or Firm*—Weiser, Stapler & Spivak

[57] ABSTRACT

An apparatus for applying a liquid or light fluid paste cosmetic preparation to the eyes or face is disclosed. The apparatus includes a handle connected to a wand which has an applicator affixed to it at its free end. The wand, when in use, is angularly positioned whereby the center line of the applicator is angularly oriented with respect to the center line of the handle. In some embodiments of the invention, the angle may be varied by a flexible joint or pivot.

4 Claims, 12 Drawing Figures

APPLICATOR FOR LIQUID COSMETICS

This is a continuation, of application Ser. No. 823,744, filed Aug. 11, 1977 now abandoned.

BACKGROUND OF THE INVENTION

This invention relates to an apparatus for storing and applying a liquid or light fluid paste cosmetic preparation to the user's face in general, and to the application of liquid eye makeup in particular.

There are many different types of apparatus and applicators shown in the prior art for applying cosmetic preparations to the face. The prior art is replete with such devices, many of which include a brush for applying a liquid cosmetic preparation.

The most common type of applicator for liquid cosmetic eye preparation is the well-known construction wherein the liquid cosmetic preparation is contained within a capped bottle. The bottle cap has a wand connected to it. A brush element or other type of applicator is connected to the end of the wand. In use the cap is unscrewed from the bottle and the wand and the connected applicator are removed from the bottle along with the cap. The cap is then used as a handle while the cosmetic is being applied to the face.

There have been various problems associated with this particular prior art apparatus. A significant problem has been the fact that an excessive amount of liquid cosmetic makeup has adhered to the applicator subsequent to its removal from the bottle. This has necessitated a somewhat messy and intermittently effective method of removing the excess liquid from the applicator sliding the applicator by along the inner portion of the neck of the bottle.

An equally significant problem associated with this prior art apparatus has been the difficulty in using it to apply eye makeup to either eye with one hand. This has resulted in the simple but awkward requirement that the user of this particular applicator exchange the device from one hand to the other. Users of eye makeup find this action inconvenient and awkward. The inability to simply use the bottle cap applicator with one hand, for both eyes, has resulted from the fact that the wand to which the brush is attached is straight. The user of the applicator, for example, when using the left hand to apply eye makeup to the right eye, while at the same time attempting to view the process in a makeup mirror, must pass the left hand and arm from one side of the body to the other thereby blocking the user's view of the procedure. Additionally when using the right (left) hand to apply the cosmetic to the left (right) side of the face, the hand must be bent or cocked in an unnatural and uncomfortable position.

SUMMARY OF THE INVENTION

The present invention relates generally to an improved apparatus for applying liquid cosmetic makeup to the face and includes an applicator or brush element which can be angularly attached or otherwise connected to a handle. This results in the axis or center line of the applicator being placed at an angle to the center line, or longitudinal axis, of the handle. It is this angle which enables the user of the device to easily, simply, and expeditiously hold the apparatus with one hand while applying a liquid cosmetic preparation to either side of the face.

In the particular embodiments described herein, the apparatus is useful to apply liquid cosmetic eye preparations to the eye. In some embodiments of the invention, the angle between the applicator and the handle may be varied, and in other embodiments, the angle may be fixed.

It is therefore an object of the present invention to provide an improved applicator for liquid cosmetics of the type set forth.

It is another object of the present invention to provide an improved liquid cosmetic applicator which, when held by one hand, may be easily and expeditiously used to apply a liquid cosmetic preparation to either eye.

It is another object of the present invention to provide an improved cosmetic applicator for containing and storing a liquid cosmetic preparation when it is not in use.

It is an additional object of the present invention to provide an improved liquid cosmetic applicator which may be used to apply a liquid cosmetic preparation to both sides of the face when it is held by one hand and which contains and stores a quantity of liquid cosmetic preparation.

It is another object of the present invention to provide a novel liquid cosmetic applicator which is adapted to be held by one hand and which includes a brush element connected to a wand which is in turn connected to a handle and wherein the longitudinal axis of the handle is angularly oriented with respect to the longitudinal axis of the brush element.

It is still a further object of the present invention to provide a novel liquid cosmetic applicator comprising a handle and a brush element in angular relationship wherein the angle between the handle and brush element may be varied.

It is still a further object of the present invention to provide a novel liquid cosmetic applicator comprising a liquid cosmetic container, a brush element and means to introduce the liquid cosmetic preparation to the brush element interiorly.

It is another object of the present invention to provide a novel applicator for liquid cosmetics, which when held in one hand, may be easily and expeditiously used to apply a liquid cosmetic preparation to the eyes which includes a hollow wand connecting a brush element to a handle, wherein the wand is adapted to vary the angle between the brush element and the handle and wherein the liquid cosmetic preparation is stored within the handle and is interiorly applied to the brush element by squeezing the handle.

DESCRIPTION OF THE PREFERRED EMBODIMENTS OF THE INVENTION

Figure 1:
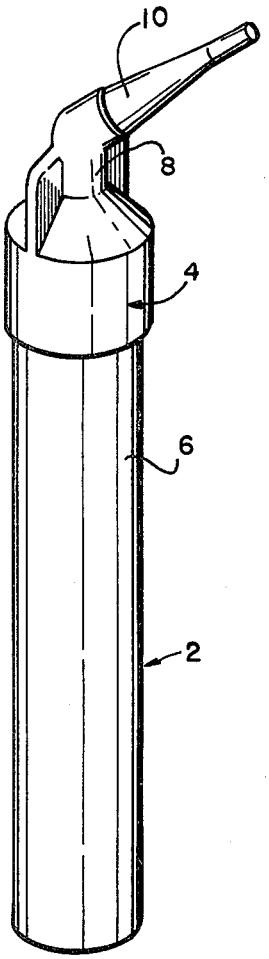
FIG. 1 is a perspective view of one embodiment of the present invention.

Although specific terms are used in the following description for the sake of clarity, these terms are intended to refer only to the particular structure of the invention selected for illustration in the drawings and are not intended to define or limit the scope of the invention.

As used herein the words "brush element" or "applicator" are defined to include all types of applicators such as brushes with hair therein, flow through sponges, loosely knit felt, rolled-up porous plastic, or other applicator means suitable for applying liquids and light fluid pastes.

Figure 2:
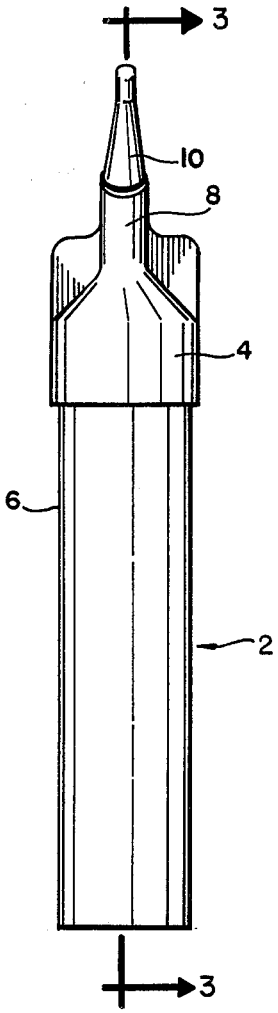
FIG. 2 is a front elevation view of the embodiment of the invention shown in FIG. 1.

Referring now to the drawings, there is shown in FIGS. 1 and 2 an apparatus, generally designated 2 for applying a liquid cosmetic preparation 12 to the face in general and to the eyes in particular. A cap 4 is shown overfitting a flexible handle 6. Also illustrated in FIG. 1 is a portion of a wand 8, which in this case, is in part formed integrally with the cap 4. A removable cover 10 is shown covering the distal portion of the wand 8.

Figure 3:
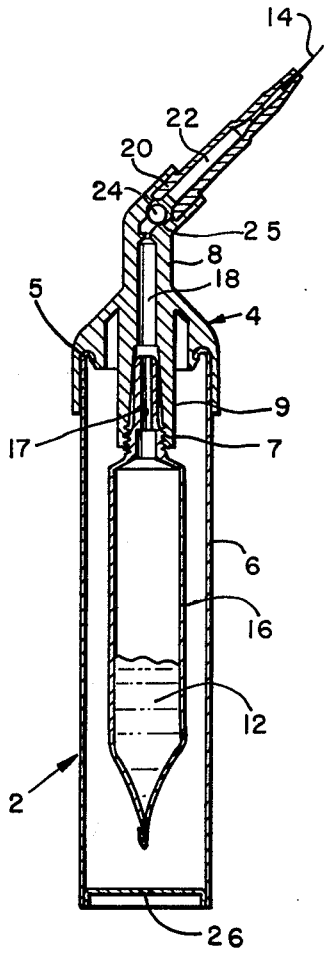
FIG. 3 is a cross-sectional view taken along line 3—3 in FIG. 2 looking in the direction of the arrows, and with the cover removed.

The details of the present invention are best shown in FIG. 3. The wand 8, through which passes the liquid cosmetic eye preparation 12 from the container 16 to an applicator or brush element 14 is angularly fabricated so that its longitudinal axis is bent. The wand 8 extends downwardly in a concentric boss 9 which includes an internal threaded section 7 to threadedly engage a flexible liquid container 16. The flexible liquid container 16 contains and holds the liquid cosmetic preparation 12. The lower portion of the wand 8 includes a hollow passage 18 which communicates with the channel opening 17 to permit the liquid eye preparation 12 to pass through the wand 8.

The upper portion of the wand 20 includes a hollow passage 22, which is in fluid communication with the passages 17, 18 and also permits the liquid cosmetic preparation 12 to pass through. In operation, upon squeezing the handle 6 and consequently the container 16, the liquid cosmetic preparation 12 passes through the passages 17, 18, 22 and is injected into the applicator 14 from within, i.e. internally.

Interspersed and positioned within the wand 8 between that portion of the wand 8 integrally formed by the cap 4 and the wand extension 20 is a one way valve comprising a small ball 24. During manufacture, the ball 24 is positioned as shown in FIG. 3 and the wand extension 20 may be cemented or otherwise secured to the wand 8. The ball 24 rests upon the seat 25 to act as a one-way valve and to prevent backflow therethrough.

The ball 24 permits the liquid cosmetic preparation 12 to pass upwardly through the passage 18 in the cap 4 about the ball 24 and through the passage 22 in the wand extension 20 to reach the applicator 14. Of course, the liquid cosmetic preparation 12 only flows in the manner thus described when the flexible handle 6 and the flexible liquid container 16 are manually squeezed. The ball 24 seats upon the seat 25 and acts to prevent the liquid cosmetic preparation 12 from flowing downwardly from passage 22 into the passage 18 and into the flexible container 16 when manual pressure is released. This prevents air, which would have the tendency to dry the liquid cosmetic preparation 12, from entering the liquid container 16. A hole 26 is provided in the bottom of the flexible handle 6 to permit it to breath and resume its normal shape when manual squeezing pressures are released.

The cap 4 may be connected to the flexible handle 6 in different manners. As may be seen in FIG. 3, a snapably engagable and disengagable configuration 5 has been illustrated. It is to be understood that other connecting means may be equally used, for example, the interconnection could be threaded. The flexible liquid container 16 is threadedly engaged to the wand 8, thus providing an airtight seal. In order to change the container 16 for refill or change of color purposes, the handle 6 is removed from the cap 4 by separating the parts of the connection 5. The container 16 is thus exposed and may be threadedly disengaged and replaced at the threaded section 7. When the cap 10 is removed from the wand 8, the upper portion of the wand or extension 20 and the attached applicator 14 are exposed for cosmetic application purposes.

In operation, the user of the apparatus 2 may select a particular container 16 having the desired liquid cosmetic contained within it and then threadedly connect it to the wand 8 at the threaded section 7. By squeezing the handle 6 sufficiently to squeeze also the liquid container 16, the liquid cosmetic 12 will flow through the passages 17, 18 and 22 and thence internally into the applicator 14.

Due to the angular displacement of the wand 8 and the applicator 14, as illustrated, the device 2 may be held in one hand while the liquid cosmetic preparation 12 is being applied to either side of the face. The angular displacement of the applicator 14 relative to the handle 6 enables different portions of the face to be easily and expeditiously reached while the person using the device can observe the process in a mirror. Different liquid cosmetics may be readily used with the single device by merely exchanging containers 16 having different liquid cosmetic preparations contained herein. Subsequent to changing a liquid cosmetic container 16, a small amount of the new liquid cosmetic 12 should preferably be injected through the passages 17, 18 and 22 and through the applicator 14 prior to actual facial application so as to purge the passages and the applicator 14 of the remains of the liquid preparation 12 which had been previously used.

Figure 4:
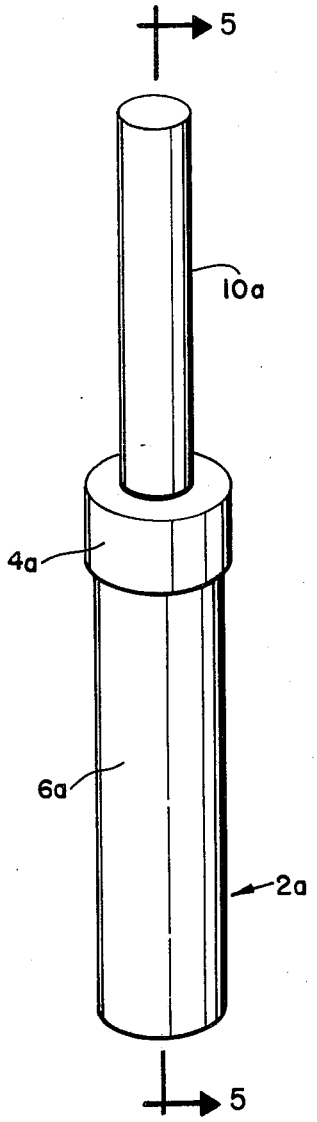
FIG. 4 is a perspective view of a second embodiment of the invention.
Figure 5:
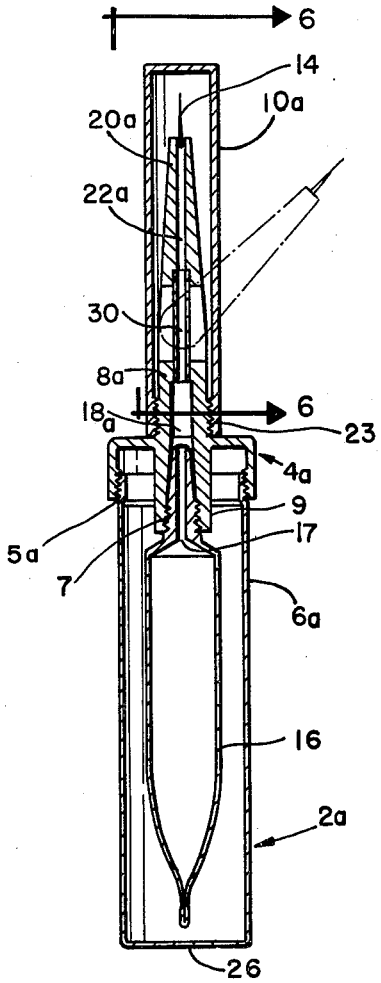
FIG. 5 is a cross sectional view taken along line 6—6 in FIG. 4, looking in the direction of the arrows.
Figure 6:
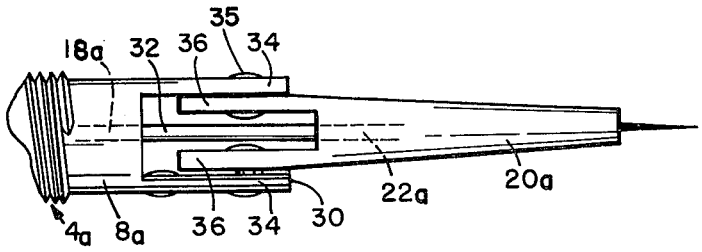
FIG. 6 is a partial, enlarged cross sectional view of the second embodiment of the invention taken along line 6—6 in FIG. 5, looking in the direction of the arrows, with the cover removed.

Referring now to FIGS. 4, 5 and 6, a second embodiment of the present invention is shown. As in the embodiment of FIGS. 1–3, a flexible handle 6*a* is shown having a cap 4*a* connected to it. The cap 4*a* in this second embodiment is threadedly engaged to the flexible handle 6*a* at the threaded connection 5*a*. The brush cover 10 may be threadedly engaged to the cap 4*a* at the threaded section 23. As in the prior embodiment, a portion of the wand 8*a* is formed by the cap 4*a*. The upper portion wand or extension 20*a* is pivotally connected to the cap 4*a* by hinge 30 to facilitate angular orientation of the applicator 14 relative to the handle 6*a* in the manner illustrated in phantom lines in FIG. 5. The portion of the wand 8*a* formed by the cap 4*a* includes a passage 18*a* through it. The upper portion wand or extension 20*a* is formed to include a hollow passage 22*a*. The brush element 14 is connected to the upper portion of the wand 20*a* in a manner similar to that described for the prior embodiment of the invention. The passages 22*a* and 18*a* are in fluid communication with the hollow passage 17 of the flexible container 16. As hereinbefore described, the container 16 threadedly connects to the threaded section 7 of the cap boss 9 to permit easy replacement.

Referring now to FIG. 6, the details of the hinge 30 are depicted. A flexible tube 32 interconnects the passages 18*a* and 22*a*. Arms 34 may be integrally formed in the cap 4*a* and may be riveted or otherwise suitably pivotally connected to the arms 36 which are integrally formed in the wand extension 20*a*. The interface between the arms 34 and the arms 36 may be designed to permit a finite series of discreet angles to be formed between the cap 4*a* and the upper portion of the wand 20*a*, or it may be designed to permit an infinite number of angles to be so formed. Design variations of this type and nature are readily apparent to those skilled in the art and may be accomplished for example by including serations or ribs in the arms 34 and 36, or by simply varying the pressure or degree of force which is applied to compress arms 34 and 36 together about the pivot pins 35.

The ability to vary the degree of angular displacement of the wand 8*a* from the longitudinal axis of the handle 6*a* permits the users of the applicator to easily vary the angle to suit particular needs and requirements at the time and place of application. The particular angular position will vary from person to person according to individual preferences to achieve the most comfortable position. The particular needs of an individual can also vary depending upon circumstances and conditions as illustrated in FIG. 5. This particular embodiment also permits the wand 8*a* to be straightened into axial alignment with the handle 6*a* when the cover 10*a* is positioned over the cap 4*a*. This may, depending upon individual preferences and needs, make storage of the applicator 2*a* easier and more convenient. If desired, a one way ball valve 24 may be employed in the manner hereinbefore set forth in the embodiment of FIG. 3.

Figure 7:
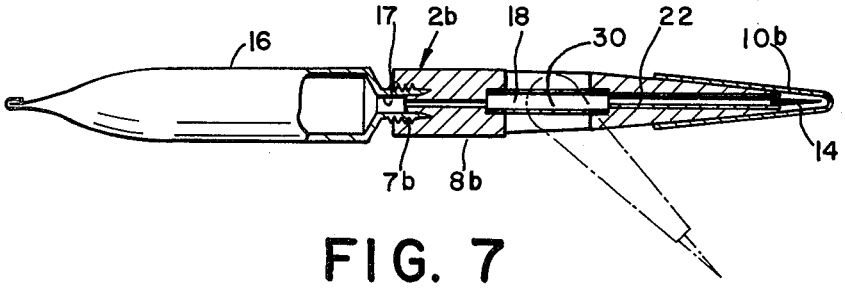
FIG. 7 shows a side elevation view, partially broken away and partly in section, of another embodiment of the present invention.

Another embodiment of the invention, which is similar to the embodiment of FIGS. 4–6, is shown in FIG. 7. In this embodiment, the apparatus 2*b* comprises a cover 10*b* which does not extend downwardly past the hinge 30. The user of this particular embodiment may cover the device while leaving the wand 8*b* at the desired angle of deflection. As illustrated, the container 16 is uncovered and no additional handle is employed. The container connects directly to the wand 8*b* in a threaded junction 7*b*.

Figure 8:
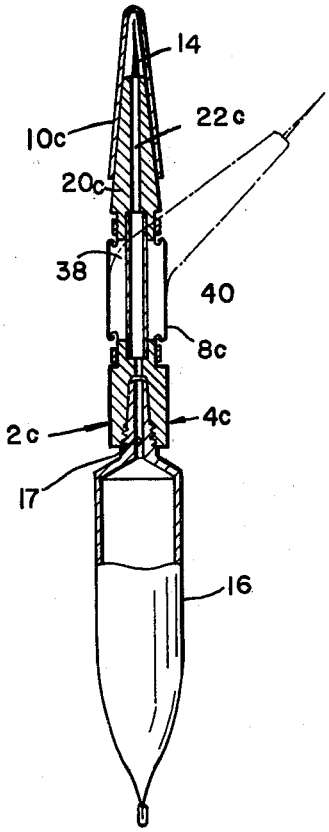
FIG. 8 shows a side elevation view, partially broken away and partly in section, of another embodiment of the present invention.

Another variation 2*c* of the invention is shown in FIG. 8 wherein the hinge 30 shown in FIGS. 6 and 7 has been replaced by a universal joint or hinge 38. The universal hinge 38 is made of any suitably flexible material and has a passageway 40 passing therethrough to permit the liquid cosmetic 12 to pass through the hinge when the container 16 is compressed. The modified wand 8*c* includes a portion of the cap 4*c*, the universal hinge 38, and an upper portion or wand extension 20*c*. This embodiment of the invention permits the user of the apparatus to have an infinite choice of angles and will permit the angle to be varied without rotating the device with respect to the hand in which it is being held. Upon squeezing the container 16, the liquid cosmetic 12 will flow to the applicator in a similar manner through the aligned passages 17, 40 and 22*c*. A cover 10*c* can be provided to protect the brush 14 in the usual manner.

Figure 9:
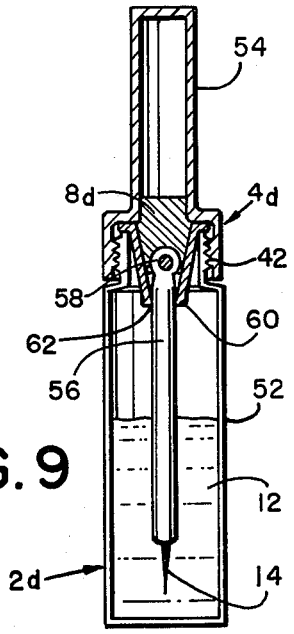
FIG. 9 is a sectional view, showing another embodiment of the present invention.
Figure 10:
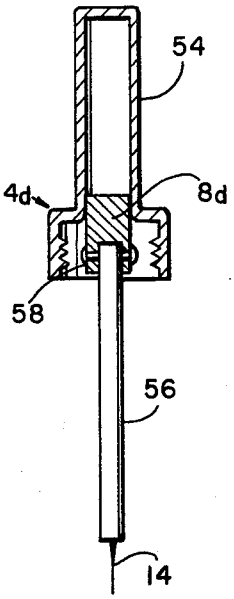
FIG. 10 is a side elevation view, partly in section, showing the cap and wand of the embodiment of the invention shown in FIG. 9.

Referring now to FIGS. 9 and 10, another embodiment 2*d* of the invention is shown which is similar in configuration to certain of the devices known in the prior art and which have previously been mentioned. A rigid container 52 is provided containing a liquid cosmetic preparation 12. A cap 4*d* is shown engaged to the container 52 at the threaded connection 42. The cap 4*d* has an elongated handle portion 54 by which the cap (and the applicator 14) is held during use. The cap 4*d* and the elongated portion 54 from another embodiment of an operating assembly in conjunction with the modified wand 8*d*. As shown in FIG. 9 a lower portion of the wand or lower wand extension 56 is inserted into the rigid container 52 and into the liquid cosmetic 12. An applicator 14 is connected at the end of the lower portion of the wand extension 56 in well known manner. The lower portion of the wand 56 may be connected to the cap 4*d* by a pin 58.

The pin 58 acts as a hinge and permits the wand 8*d* to be angularly bent between the portion formed by the cap 4*d* and the elongated portion 54 and the lower portion or wand extension 56. The desirable feature of the angular displacement of the brush element 14 relative to the elongated handle portion 54 is achieved, thus enabling one hand to be used to apply the liquid cosmetic preparation 12 to either side of the face with maximum observation.

Referring still to FIG. 9, a hollow, truncated, cone-like wiper 60 is interiorly affixed near the top of the container 52. The wiper may be secured to the container 52 by any means well known to those skilled in the art. A bottom opening 62 is provided in the wiper 60 of slightly smaller diameter than that of the wand lower extension 56. It is readily apparent that when the cap 4*d* is unscrewed from the rigid container 52 and the lower extension 56 of the wand and the attached applicator 14 are removed, any excess liquid cosmetic preparation 12 which may be clinging to the lower portion 56 of the wand will be scraped or otherwise removed therefrom. This embodiment of the invention provides construction permitting angular displacement of the want during use, direct storage of the applicator within the cosmetic and means for removing excess liquid cosmetic 12 from the wand extension 56 and the applicator 14 to prior to use.

Figure 11:
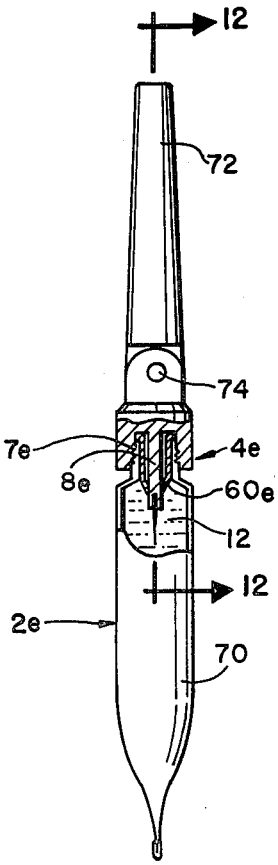
FIG. 11 is a front elevation view, partially broken away, of another embodiment of the present invention.
Figure 12:
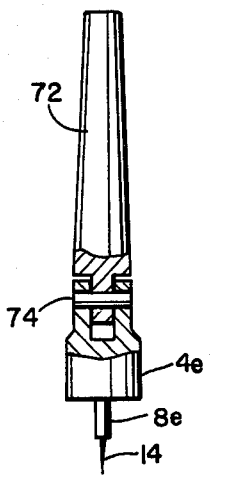
FIG. 12 is a partial, cross sectional view, taken along line 12—12 of FIG. 11, looking in the direction of the arrows.

Another embodiment 2*e* of the invention is illustrated in FIGS. 11 and 12. In this embodiment, a flexible cosmetic container 70 is threadedly engaged to a cap 4*e* at the threaded connection 7*e*. A wand 8*e*, which forms an integral portion of the cap 4*e* extends directly into the interior of the container 70 and contacts the liquid cosmetic 12. A wiper 60*e* is connected in the container 70 in position to contact the wand 8*e* whereby excess liquid cosmetic preparation 12 is removed when the wand 8*e* is removed from the container 70. A handle 72 is pivotally connected to the cap 4*e* by a pivot pin 74 in known manner to angularly offset the handle to any desired angular position. When this embodiment of the invention is employed, an angular displacement of the wand 8*e* relative to the handle 72 is achieved and excess liquid cosmetic preparation 12 can be automatically removed from the wand as the applicator 14 is withdrawn from the container 70 in preparation for use.

It is thus apparent to one skilled in the art that the present invention and the various embodiments thereof described herein provide an applicator for liquid cosmetic preparation which permits the cosmetic makeup 12 to be applied to either side of the face easily and expeditiously with either hand. In all of the embodiments illustrated, means are provided to place the applicator 14 in angular cosmetic application position. Additionally, the invention provides in some embodiments, means for eliminating or removing excess liquid cosmetic preparation from the wand, thereby making the application of liquid cosmetic preparation easier and simpler.

Although the present invention has been described with reference to particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A hand held applicator for applying a cosmetic preparation which comprises:

a hollow handle comprising enclosing, flexible walls defining an interior space containing a quantity of air, the walls having an interior surface facing toward the interior space and an exterior surface facing away from the interior space, both the entire interior wall surface and exterior wall surface normally being exposed and contacted by air;

the handle walls being provided with an unobstructed hole therethrough, the hole communicating with the interior space to permit free passage of air into and out of the interior space;

the handle walls being squeezable from a first position wherein no cosmetic preparation flows to a squeezed position wherein the cosmetic preparation flows from the applicator;

a wand operably connected to the handle, said wand having a cosmetic passage wherein the cosmetic preparation flows therethrough, the wand being connected to the handle in in an air tight junction whereby air within the handle is completely separated from the cosmetic passage;

an applicator carried by the wand for applying the cosmetic preparation delivered through the cosmetic passage; and a replaceable container positioned within the interior space and holding the cosmetic preparation, said container having flexible sidewalls and a cosmetic opening in fluid communication with the cosmetic passage, the cosmetic passage carrying the preparation from the container to the applicator, the container sidewalls, the cosmetic opening and the cosmetic passage forming a fluid path that is entirely closed whereby the cosmetic preparation is always separated from the air within the handle, the container sidewalls having a first, unsqueezed condition when the handle walls are in their first position, and a second squeezed condition when the handle walls are in their said squeezing position;

the handle walls being in direct contact with the container sidewalls when the handle walls are urged to the said squeezed position, to force a portion of the cosmetic preparation through the cosmetic opening and a portion of the air through the unobstructed hole, the portion of the interior space not occupied by the container being filled with air, the air leaving the interior space through the said hole when the handle is squeezed to the squeezed position, the air entering through the hole and surrounding substantially the entire container when the handle is in its said first position, the walls of the handle not being in contact with the sidewalls of the container when in the said first position;

whereby a hand held apparatus is provided which may be easily and simply used by one hand to apply the cosmetic preparation.

2. The hand held applicator of claim 1 wherein the junction between the handle and the wand comprises angle variation means to permit variation of the angle between the longitudinal axis of the handle and the longitudinal axis of the wand.

3. The hand held applicator of claim 2 wherein the angle variation means is adjustable.

4. The hand held applicator of claim 1 and a one way valve operably connected between the container and the wand, the one way valve being adapted to permit the flow of cosmetic preparation from the container to the wand passage and to prevent cosmetic preparation flow from the wand passage back to the container.

* * * * *